US010221709B2

(12) United States Patent
Brandl et al.

(10) Patent No.: US 10,221,709 B2
(45) Date of Patent: Mar. 5, 2019

(54) GAS TURBINE VANE

(71) Applicant: ANSALDO ENERGIA SWITZERLAND AG, Baden (CH)

(72) Inventors: Herbert Brandl, Waldshut-Tiengen (DE); Marc Widmer, Winterthur (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 366 days.

(21) Appl. No.: 14/974,831

(22) Filed: Dec. 18, 2015

(65) Prior Publication Data

US 2016/0177760 A1 Jun. 23, 2016

(30) Foreign Application Priority Data

Dec. 18, 2014 (EP) ..... 14198730

(51) Int. Cl.
*F01D 9/04* (2006.01)
*F01D 25/12* (2006.01)

(52) U.S. Cl.
CPC ..... *F01D 9/041* (2013.01); *F01D 25/12* (2013.01); *F05D 2220/32* (2013.01); *F05D 2240/122* (2013.01); *F05D 2240/80* (2013.01); *F05D 2240/81* (2013.01); *F05D 2260/941* (2013.01)

(58) Field of Classification Search
CPC ..... F01D 9/041; F01D 25/12; F05D 2220/32; F05D 2240/122; F05D 2240/80; F05D 2240/81; F05D 2260/941
USPC ..... 415/193 A
See application file for complete search history.

(56) References Cited

U.S. PATENT DOCUMENTS 2,873,088 A * 2/1959 Neumann ..... F01D 5/3007 416/193 A
3,304,055 A * 2/1967 Britt ..... F01D 5/08 416/222
3,503,696 A * 3/1970 Bouiller ..... F01D 1/24 269/287
4,120,607 A * 10/1978 Coplin ..... F01D 21/045 416/193 A
4,457,668 A * 7/1984 Hallinger ..... F01D 5/26 416/190
5,193,982 A * 3/1993 Inizan ..... F01D 11/008 416/193 A (Continued)

FOREIGN PATENT DOCUMENTS

EP 2 290 195 A2 3/2011
EP 2 354 460 A1 8/2011

OTHER PUBLICATIONS

Search Report dated Jun. 1, 2015, by the European Patent Office as the Searching Authority for International Application No. 14198730. 5, 6 pages.

*Primary Examiner* — Logan M Kraft
*Assistant Examiner* — Brian Christopher Delrue
(74) *Attorney, Agent, or Firm* — Buchanan Ingersoll & Rooney PC

(57) ABSTRACT

The present invention generally relates to a vane for a gas turbine, and more in particular it provides an innovative vane with improved flexibility leading to a reduction of stresses at the transition from the vane trailing edge to the vane platform, without interfering into the cooling scheme of such component. The present invention can increase flexibility of the vane platform by introducing on the vane platform a material cutback confined in the proximity of the trailing edge portion of the vane airfoil.

6 Claims, 9 Drawing Sheets

(56) References Cited

U.S. PATENT DOCUMENTS 5,256,035 A * 10/1993 Norris ..... F01D 5/3015 416/220 R
6,082,970 A * 7/2000 Tsukamoto ..... F01D 5/24 416/190
6,273,683 B1 * 8/2001 Zagar ..... F01D 5/22 277/421
6,419,447 B1 * 7/2002 Watanabe ..... F01D 5/147 415/115
6,761,536 B1 * 7/2004 Bash ..... F01D 5/18 416/193 A
6,997,673 B2 * 2/2006 Morris ..... F01D 9/04 415/1
7,419,361 B1 * 9/2008 Byam ..... F01D 5/147 416/219 R
7,597,536 B1 * 10/2009 Liang ..... F01D 5/147 415/115
8,047,787 B1 * 11/2011 Liang ..... F01D 5/187 416/97 R
8,834,096 B2 * 9/2014 Khanin ..... F01D 11/10 415/116
8,876,479 B2 * 11/2014 Thomen ..... F01D 5/22 416/190
8,951,014 B2 * 2/2015 Corcoran ..... F01D 5/22 416/193 A
9,816,387 B2 * 11/2017 Carr ..... F01D 9/042
2002/0081205 A1 * 6/2002 Wong ..... F01D 5/147 416/219 R
2005/0036890 A1 * 2/2005 Tomberg ..... F01D 5/147 416/192
2005/0129499 A1 * 6/2005 Morris ..... F01D 9/04 415/1
2005/0135936 A1 * 6/2005 Cherolis ..... F01D 5/141 416/193 A
2008/0063529 A1 * 3/2008 Miller ..... F01D 5/147 416/193 A
2009/0208339 A1 * 8/2009 Cherolis ..... F01D 5/3007 416/219 R
2010/0329888 A1 * 12/2010 Nadvit ..... F01D 5/18 416/97 R
2011/0052381 A1 * 3/2011 Hoke ..... F01D 9/023 415/191
2011/0076155 A1 3/2011 Hofmann et al.
2011/0189002 A1 * 8/2011 Panaite ..... F01D 9/042 415/191
2012/0121384 A1 * 5/2012 Borufka ..... F01D 5/22 415/119
2012/0251331 A1 * 10/2012 Dietrich ..... F01D 5/147 416/97 R
2013/0011265 A1 * 1/2013 Miller ..... F01D 11/008 416/191
2013/0202409 A1 * 8/2013 Jones ..... F01D 5/189 415/115
2016/0138408 A1 * 5/2016 Bordne ..... F01D 5/066 416/182
2017/0074107 A1 * 3/2017 Neville ..... F01D 5/3007
2017/0152752 A1 * 6/2017 Myers ..... F01D 5/147
2017/0356297 A1 * 12/2017 Neville ..... F01D 5/187
2018/0010473 A1 * 1/2018 Carr ..... F04D 29/542

* cited by examiner

GAS TURBINE VANE

FIELD OF THE INVENTION

The present invention generally relates to a vane for a gas turbine, and more in particular it provides an innovative vane with improved flexibility leading to a reduction of stresses at the transition from the vane trailing edge to the vane platform, without interfering into the cooling scheme of such component.

BACKGROUND

As well known, a standard configuration for a gas turbine envisages a plurality of vanes solidly connected to a casing which surrounds a rotating shaft guided by blades mounted thereon. In particular, each vane comprises an airfoil which is connected to a vane platform, which is in turn retained into the external casing. As hot combustion gases pass through the casing to drive the rotating shaft, vanes experience high temperatures, and for such reason they need to be cooled. Typically, cooling configurations have a cooling medium entering the vane through the platform to the airfoil. In order to maximize the efficiency of the energy conversion process, the airfoil sections are relatively thin. In contrast, the platform sections to which they are attached are much thicker in order to provide suitable support for the airfoil.

FIG. 1 and FIG. 2 show a prior art design depicting a gas turbine vane in perspective and plan views respectively, the gas turbine vane being generally indicated with numeral reference 100 and comprising a vane airfoil 12, having a trailing edge portion 121, and a vane platform 200 including a hook portion 210. Furthermore, the vane platform 200 includes a wedge face pressure side 202 and a wedge face suction side 201 opposed thereto.

Making reference to FIG. 3, it is shown a perspective view of a portion of the gas turbine vane 10 of FIGS. 1 and 2 enclosed into the dashed box C. Not visible in the FIG. 3 is the wedge face suction side, opposed to the wedge face pressure side 202 of the vane platform 200 and the leading edge of the airfoil 12.

Making now reference to the following FIG. 4, in order to maintain proper cooling of the vane platform 200 a maximum surface is intended to be accessible for impingement cooling, especially for front stage vanes. The flow of the cooling medium is indicated with arrows A. Therefore vane hook portions 210 are shifted to extreme positions at upstream and downstream ends of the vane platform 200, thus forming a cavity, open towards the cooling air side. By positioning the downstream side hook portion 210 at the most downstream location, it almost lines up in radial direction with the trailing edge end 121 of the airfoil 12. As cooling is strictly required to ensure lifetime of the component, vane platform 200 is necessarily thick to allow proper internal cooling features. As a result, hook portion 210 close to airfoil trailing edge 121 results in a very stiff structure at the transition from airfoil trailing edge 121 to vane platform 200.

Such inflexible structure causes locally high stresses. Therefore, requiring a high amount of cooling air to maintain lifetime at reasonable levels having got a negative impact on the engine performance.

With reference to FIG. 5, it is shown a known solution to the aforementioned technical problem. In order to increase flexibility of vane platform 200, hook portion 210 is shifted inwards thus creating long overhangs 112. However, not all turbine configurations allow for such design, and, in any case, this solution causes a severe reduction of cooled area which may compromise lifetime for highly loaded parts.

SUMMARY OF THE INVENTION

The object of the present invention is to solve the aforementioned technical problems by providing a gas turbine vane as substantially defined in independent claim 1.

Preferred embodiments are defined in correspondent dependent claims.

According to preferred embodiments, which will be described in the following detailed description only for exemplary and non-limiting purposes, the present solution teaches to increase flexibility of the vane platform by introducing on the vane platform a material cutback confined in the proximity of the trailing edge portion of the vane airfoil.

Advantageously, such material cutback is a local modification which can be introduced without interfering into the cooling scheme of platform and airfoil.

According to an aspect of the invention, it is provided a gas turbine vane comprising a vane platform, a vane airfoil connected to the vane platform, the vane airfoil comprising a vane trailing edge, wherein the turbine vane further comprises a material cutback formed on the vane platform and confined in the proximity of the vane trailing edge.

According to a further aspect of the present invention, the vane platform comprises a wedge face pressure side, a wedge face suction side and a circumferential groove extending from the wedge face suction side to the wedge face pressure side.

According to a first preferred embodiment of the present invention, the material cutback is a chamfer formed on a base wall of the circumferential groove.

According to a further aspect of the first embodiment of the present invention, the chamfer is formed on a free end portion of the base wall.

According to a further aspect of the first embodiment of the present invention, the chamfer is formed on the base wall such to create a stepped region there along.

According to a further aspect of the first embodiment of the present invention, the chamfer has a longitudinal extent comprised in the range of 5-20 mm.

According to a second preferred embodiment of the present invention, the material cutback is a blind hole.

According to a further aspect of the second embodiment of the present invention, the blind hole has a depth within said vane platform comprised in the range of 5-20 mm.

According to a further aspect of the second embodiment of the present invention, the vane platform comprises sealing slots extending along the wedge faces.

According to a further aspect of the second embodiment of the present invention, the blind hole is formed on the vane platform as a terminal extension of the sealing slot.

BRIEF DESCRIPTION OF DRAWINGS

The foregoing objects and many of the attendant advantages of this invention will become more readily appreciated as the same becomes better understood by reference to the following detailed description when taken in conjunction with the accompanying drawings, wherein.

DETAILED DESCRIPTION OF THE DRAWINGS

Figure 1:
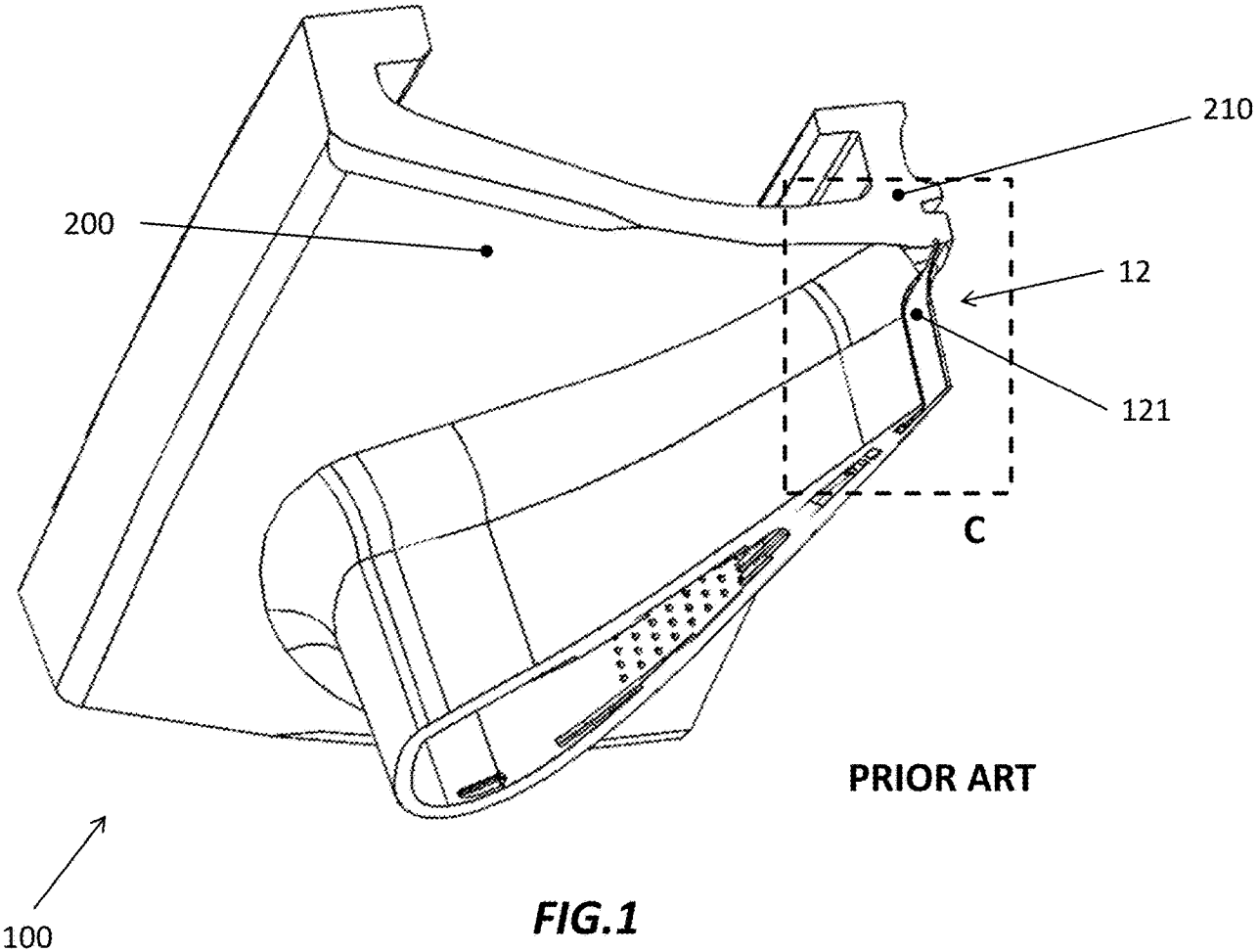
PRIOR ART FIG.1
FIGS. 1 and 2 show respectively a perspective and a plan view of a gas turbine vane according to the prior art.
Figure 2:
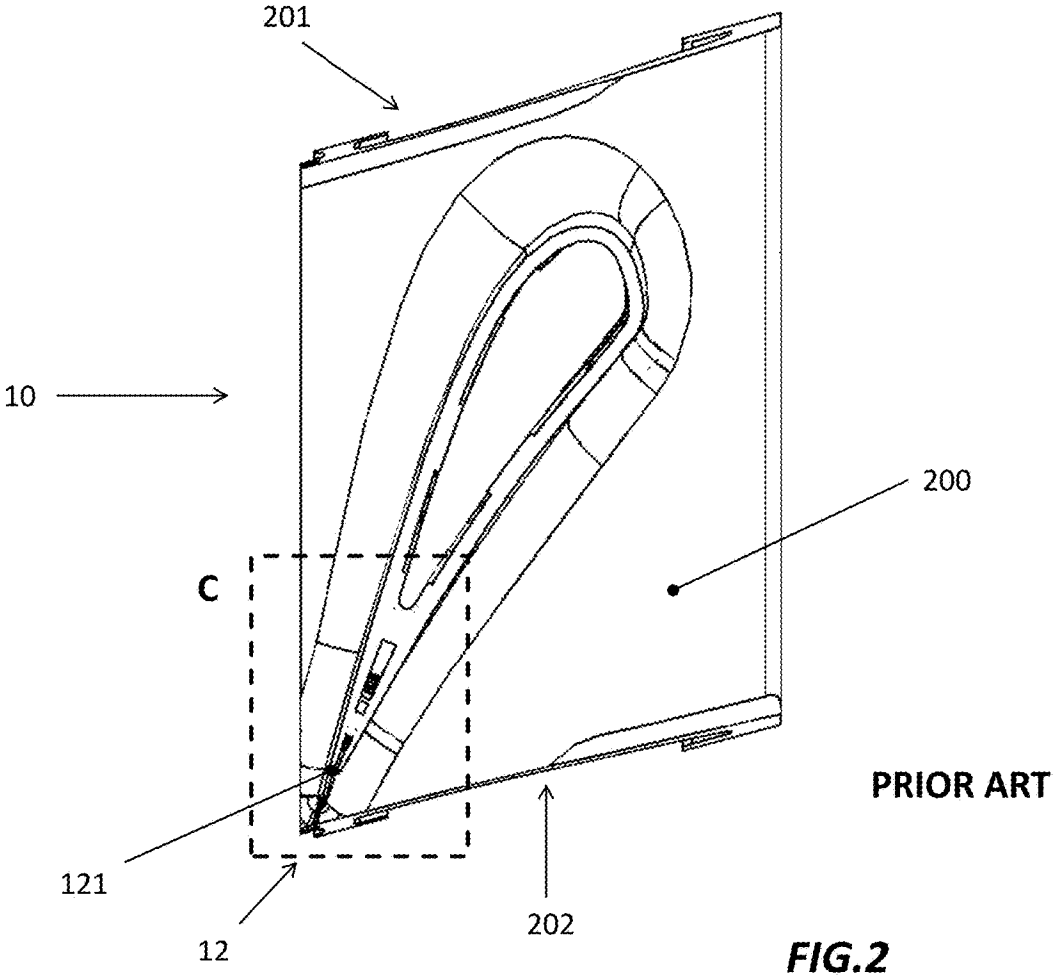
PRIOR ART FIG.2
Figure 3:
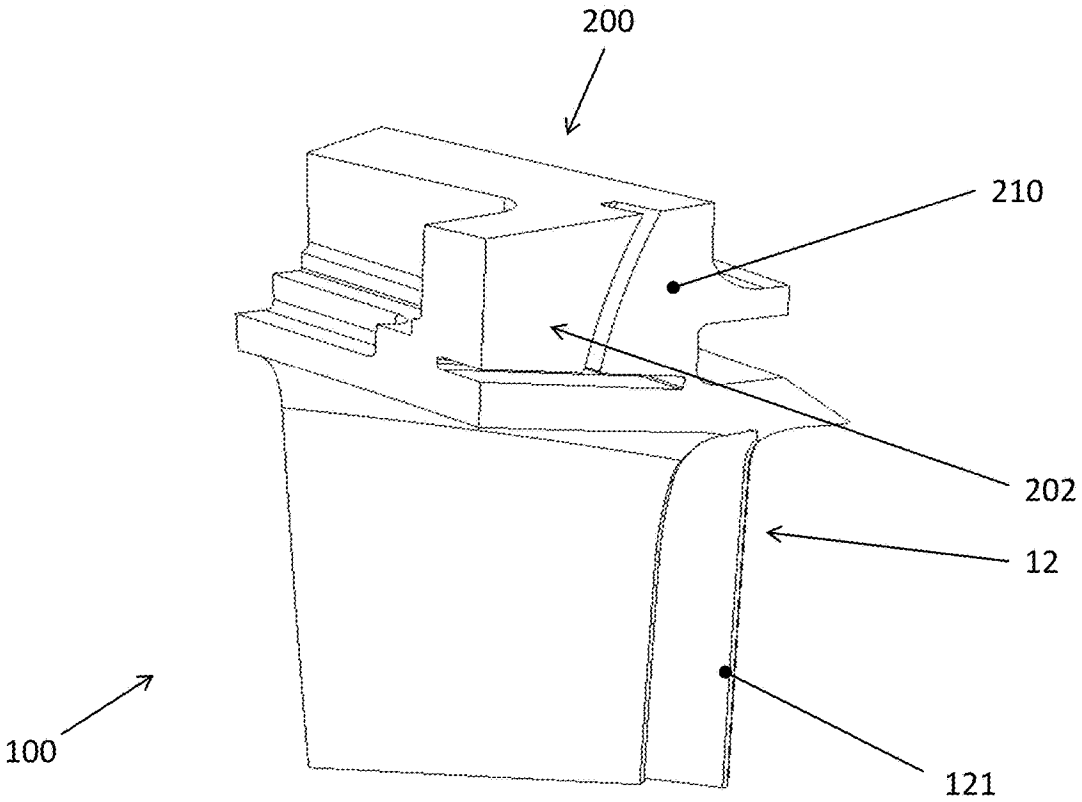
PRIOR ART FIG.3
FIG. 3 shows a perspective view of a portion of the gas turbine vane enclosed into the dashed box C of FIGS. 1 and 2.
Figure 4:
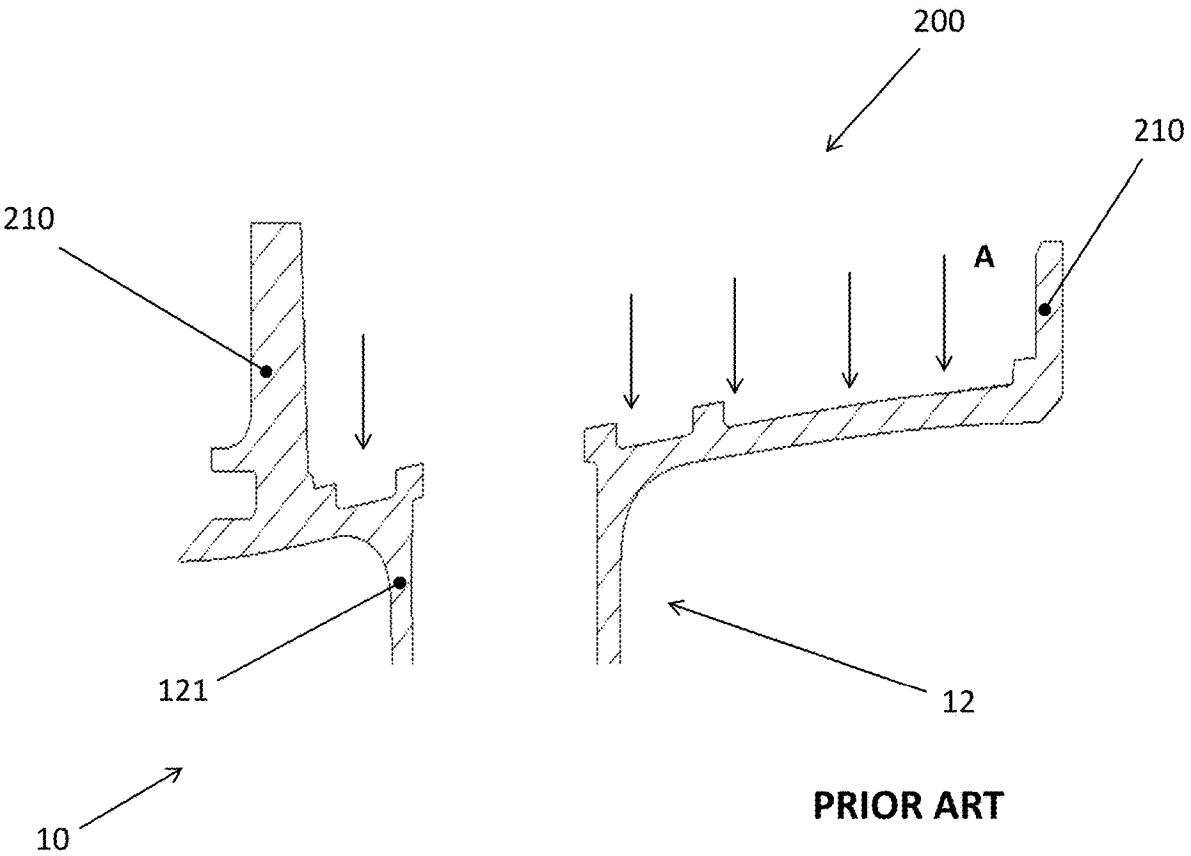
FIG. 4 shows a top lateral section view of the gas turbine vane of FIG. 1.
Figure 5:
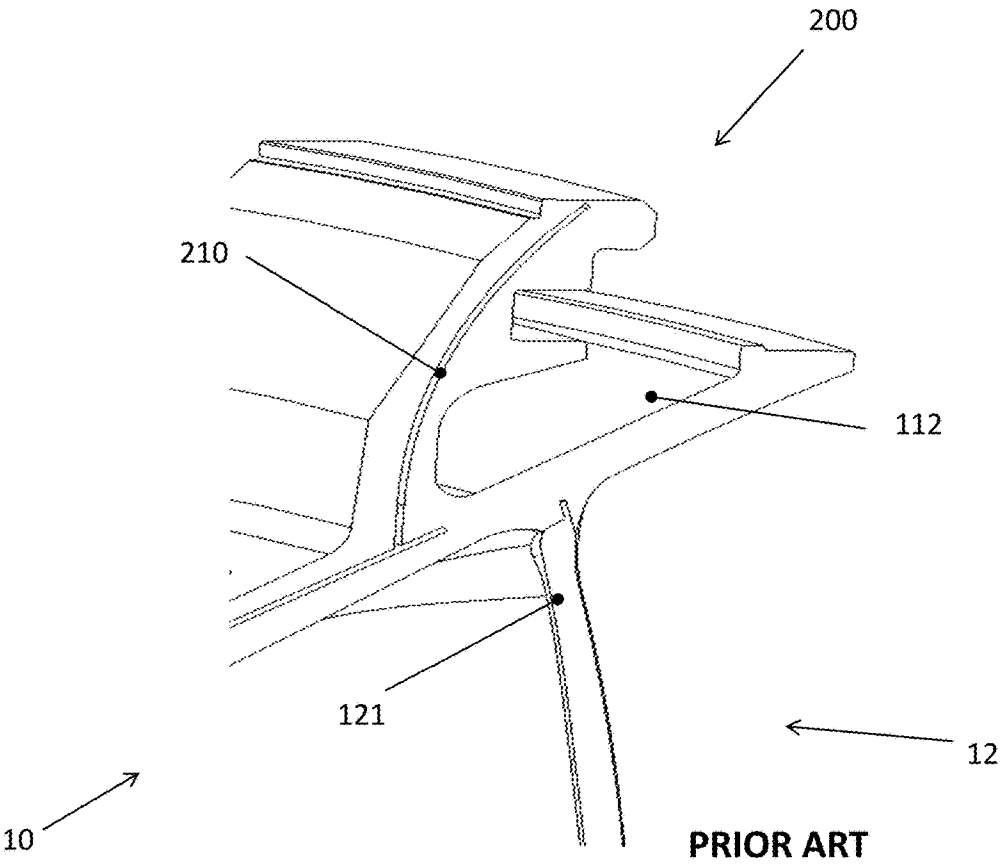
FIG. 5 shows a perspective view of a prior art gas turbine vane pertaining to a different design to the one showed in FIG. 3.
Figure 6:
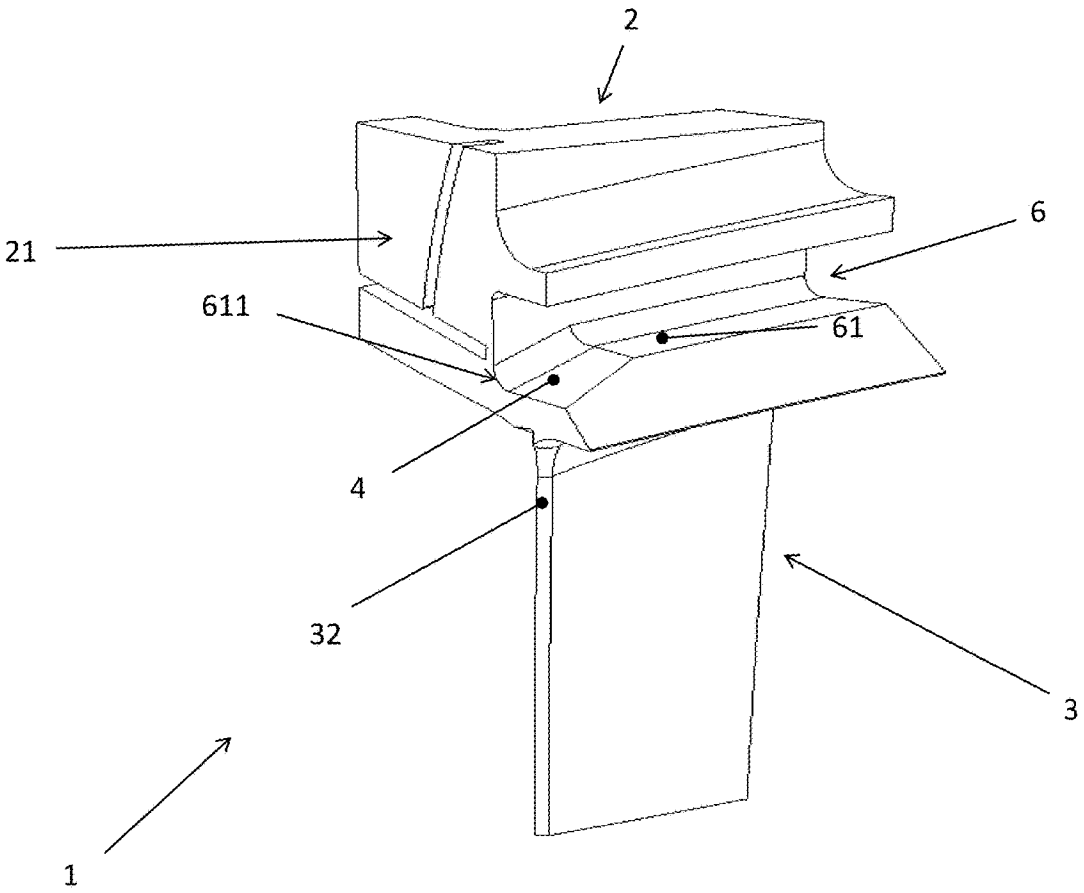
FIG. 6 shows a perspective view of a portion of a gas turbine vane according to a first embodiment of the present invention.

With reference to FIG. 6, it is shown a gas turbine vane, generally referred to with numeral reference 1. For sake of clarity, FIG. 6 shows only a portion of the gas turbine vane 1 according to the invention, corresponding to the one showed with regard to the prior art, that is the portion enclosed in the dashed box C of FIGS. 1 and 2 which depict the entire vane.

The gas turbine vane 1 comprises a vane airfoil 3, which includes a vane trailing edge 32. The leading edge is not visible in the figure. The vane airfoil is connected to a vane platform 2. Vane platform, similarly for the vane pertaining to the prior art, comprises a wedge face pressure side 21 and a wedge face suction sice opposed thereto (not visible in the figure).

In particular, the vane 1 comprises a material cutback 4 formed on the vane platform 2 confined in the proximity of the vane trailing edge 32.

According to a first exemplary embodiment, here presented as non-limiting example, the cutback is obtained in the form of a chamfer 4. More in particular, the vane platform 2 comprises a circumferential groove 6 extending from the wedge face pressure side 21 to the wedge face suction side of the platform. Advantageously, the chamfer 4 is formed on a base wall 61 of the circumferential groove 6. More in particular, the chamfer is located on a free end portion 611 of the base wall 61. However, the chamfer 4 may be also located along the base wall 61 of the circumferential groove 6.

Figure 7:
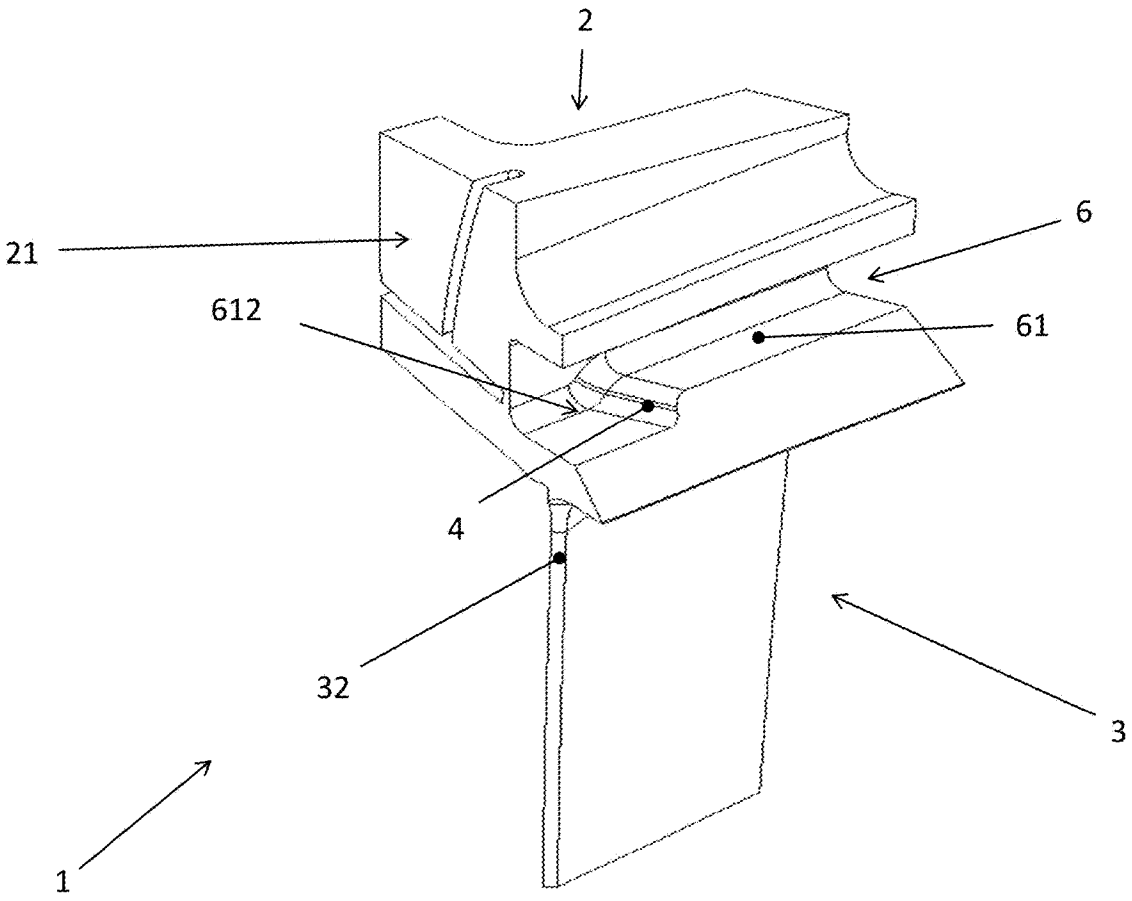
FIG. 7 shows a perspective view of a portion of a gas turbine vane according to a variant of the first preferred embodiment of the present invention.

Turning to next FIG. 7, it is shown a variant of the first preferred embodiment of the present invention. In particular, in this case the chamfer 4 is formed on the base wall 61 such to create a stepped region 612 there along. The chamfer 4, in both embodiments, can be obtained by machining the component or by means of any other suitable process known to those who are skilled in the art.

Preferably, chamfer 4 has a longitudinal extent comprised in the range of 5 to 20 mm.

In such way, the modification of the platform remains in the proximity of the trailing edge 32 of the vane platform 2, hence without interfering with the cooling scheme of the vane and, at the same time, enabling a significant reduction of stiffness of the platform. This results in less mechanical stress experienced by the component during operation.

Figure 8:
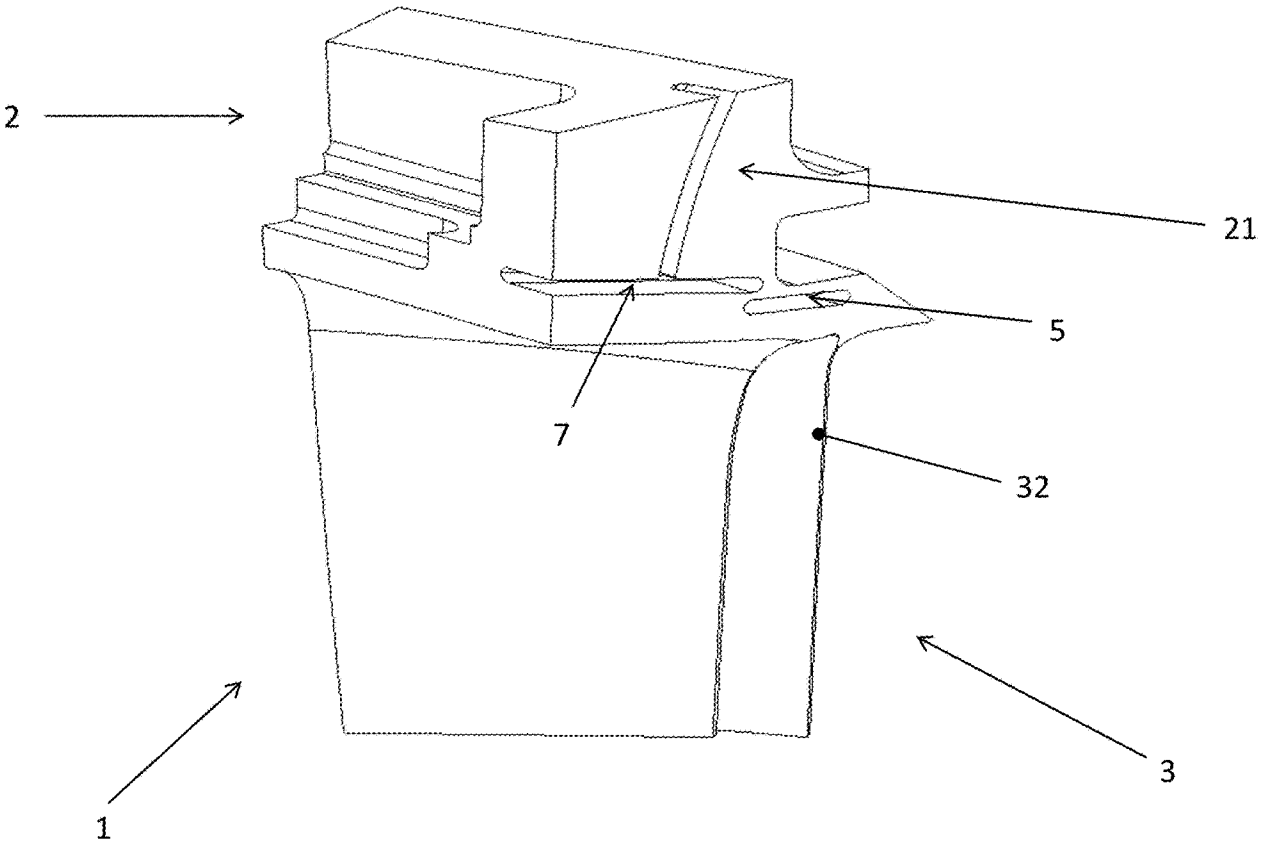
FIG. 8 shows a perspective view of a portion of a gas turbine vane according to a second preferred embodiment of the present invention.

Making now reference to following FIG. 8, it is shown in perspective view a second preferred embodiment of the present invention. Accordingly, the material cutback is obtained in the form of a blind hole 5, formed on the vane platform 2 in the proximity of the trailing edge 32 of the vane airfoil 3.

Similarly, the blind hole may be obtained by machining the component or by any other means known to those who are skilled in the art.

Preferably, the blind hole 5 may have a depth in the vane platform 2 comprised in the range of 5 to 20 mm.

As shown in the figure, vane platform 2 also comprises a sealing slot 7 located on wedge face pressure side 21 of the vane platform 2.

Figure 9:
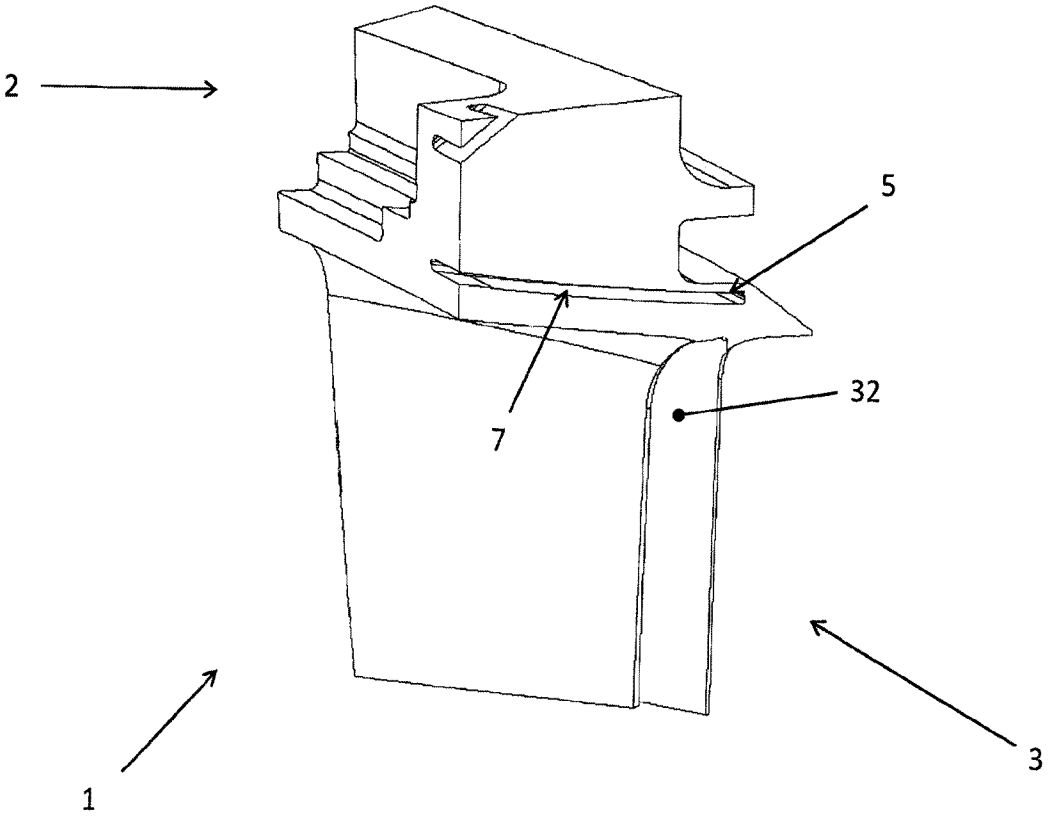
FIG. 9 shows a perspective view of a portion of a gas turbine vane according to a variant of the second preferred embodiment of the present invention.

With reference to last FIG. 9, it is shown a variant of the second preferred embodiment of the invention. In particular, advantageously, the blind hole 5 is formed on the vane platform 2 as a terminal extension of the sealing slot 7. Said differently, in this variant the sealing slot further extends towards the proximity of the trailing edge 32 of the vane airfoil 3.

Although the present invention has been fully described in connection with preferred embodiments, it is evident that modifications may be introduced within the scope thereof, not considering the application to be limited by these embodiments, but by the content of the following claims.

The invention claimed is:

1. A gas turbine vane, comprising:

a vane platform including a wedge face pressure side, a wedge face suction side and a circumferential groove extending from said wedge face pressure side to said wedge face suction side;

a vane airfoil connected to said vane platform, the vane airfoil having a vane trailing edge and a vane leading edge; and a material cutback formed on said vane platform confined at said vane trailing edge, wherein the material cutback is a chamfer that declines from the leading edge toward the trailing edge and declines from a portion proximate an outer surface of the vane platform to a portion proximate the vane airfoil, the chamfer being formed on a base wall of the circumferential groove.

2. The gas turbine vane according to claim 1, wherein said chamfer is formed on a free end portion of said base wall.

3. The gas turbine vane according to claim 1, wherein said chamfer is formed on said base wall to create a stepped region there along.

4. The gas turbine vane according to claim 3, wherein said chamfer has a depth in a range of 5-20 mm.

5. The gas turbine vane according to claim 1, wherein said chamfer has a depth in a range of 5-20 mm.

6. The gas turbine blade according to claim 1, wherein said vane platform comprises:

a sealing slot extending along said wedge face pressure side.

* * * * *